US005248057A

United States Patent [19]

Taylor

[11] Patent Number: 5,248,057

[45] Date of Patent: Sep. 28, 1993

[54] VERSATILE DOUBLE ACTUATION TRASH CONTAINER LID

[76] Inventor: Craig V. Taylor, 8924 Enfield Ave., Northridge, Calif. 91325

[21] Appl. No.: 883,840

[22] Filed: May 15, 1992

[51] Int. Cl.[5] ..... B65D 43/14

[52] U.S. Cl. ..... 220/333; 220/331; 220/908; 220/335; 220/343; 220/380; 220/263

[58] Field of Search ..... 220/331, 333, 908, 335, 220/343, 380, 263; 414/407, 408; 296/219, 100, 101

[56] References Cited

U.S. PATENT DOCUMENTS

| | | | |
|---|---|---|---|
| 1,431,288 | 10/1922 | Corder | 220/333 |
| 2,014,591 | 9/1935 | Sanders | 220/331 X |
| 3,567,062 | 3/1971 | Reed | 220/335 |
| 4,152,979 | 5/1979 | Schmidt | 220/331 X |
| 4,391,386 | 7/1983 | Moret | 220/333 X |
| 4,771,940 | 9/1988 | Taylor | 220/335 |
| 5,092,484 | 3/1992 | Daugherty et al. | 220/331 |

FOREIGN PATENT DOCUMENTS

| | | | |
|---|---|---|---|
| 2011302 | 6/1990 | United Kingdom . | |
| 2234222 | 1/1991 | United Kingdom | 220/908 X |

*Primary Examiner*—Allan N. Shoap
*Assistant Examiner*—Paul A. Schwarz
*Attorney, Agent, or Firm*—Poms, Smith, Lande & Rose

[57] ABSTRACT

Disclosed herein is a versatile double actuation lid assembly for commercial trash containers of the type having a main rear generally rectangular volume and a slanted front opening making a predetermined acute angle with respect to the horizontal. The front and rear sections of this lid have aligned lower edge surfaces for resting on the edges of the containers front openings. Each of the lid sections is formed of two spaced layers of plastic material. A means for pivotally actuating the lid sections together, including hinge lugs on each lid section extending towards the other, a pivot bar extending through openings in these hinge lugs, and an actuating lever for pivotally actuating the lid sections together. The clearance angle between the upper surfaces of the front and rear lid sections is sufficient so that the lid may be opened to a stable position slightly beyond the vertical while the rear lid section remains fully closed, for the deposit of small items of trash.

29 Claims, 7 Drawing Sheets

FIG. 1
PRIOR ART
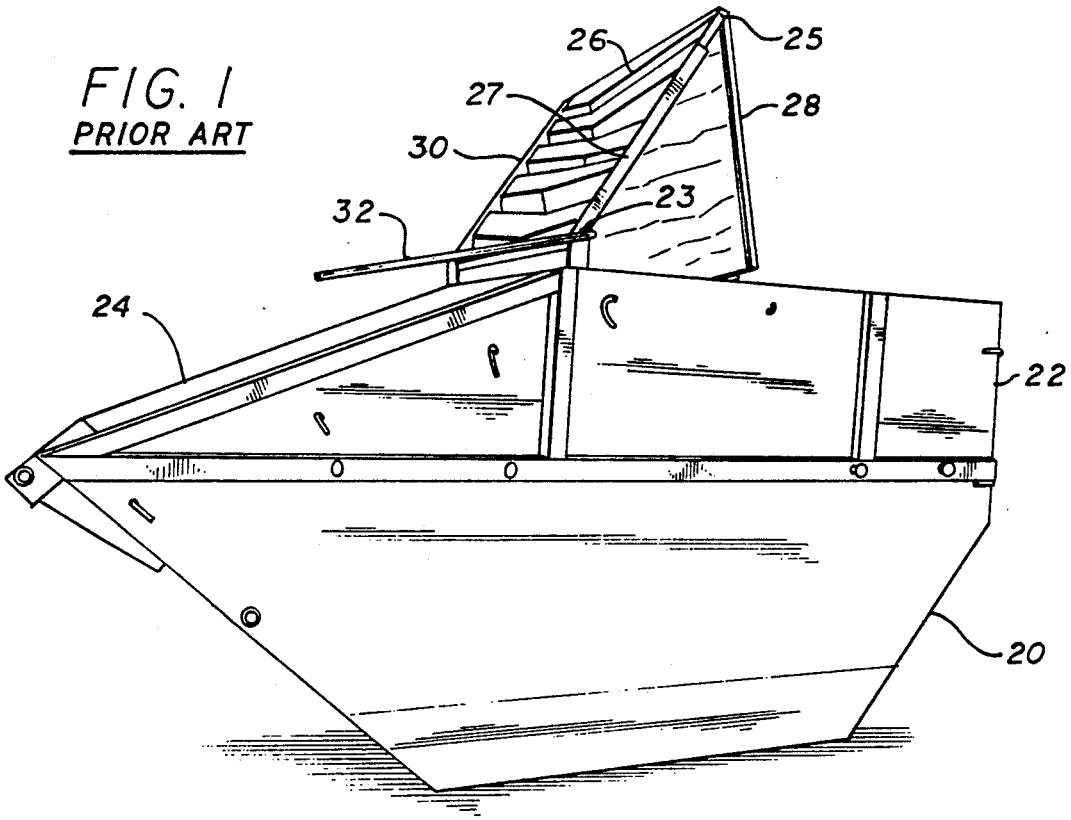
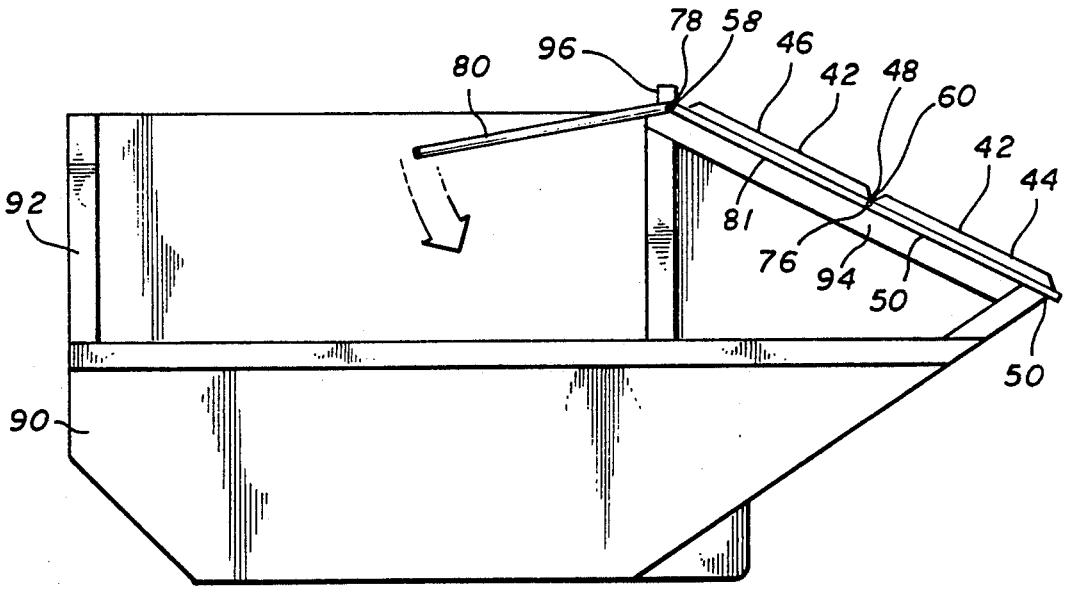
FIG. 2

FIG. 3
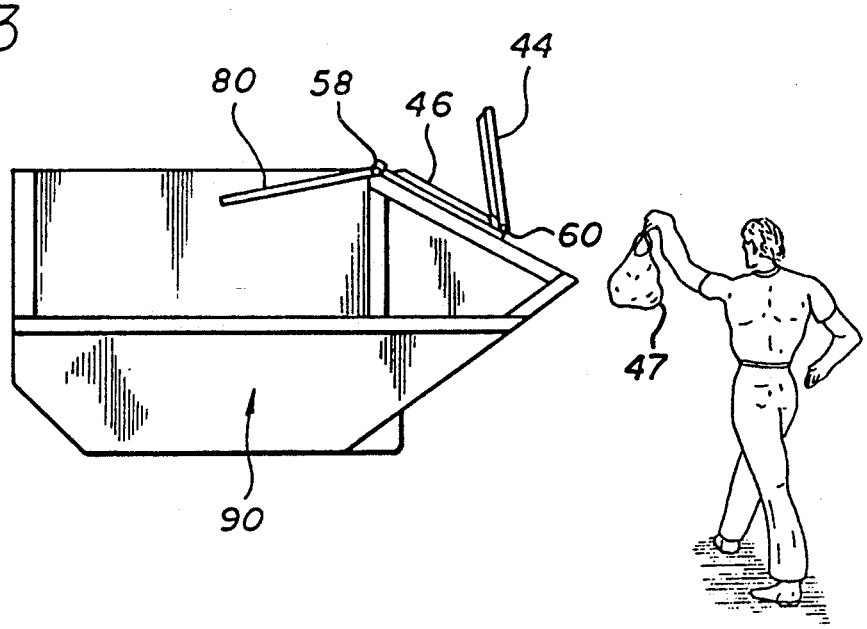
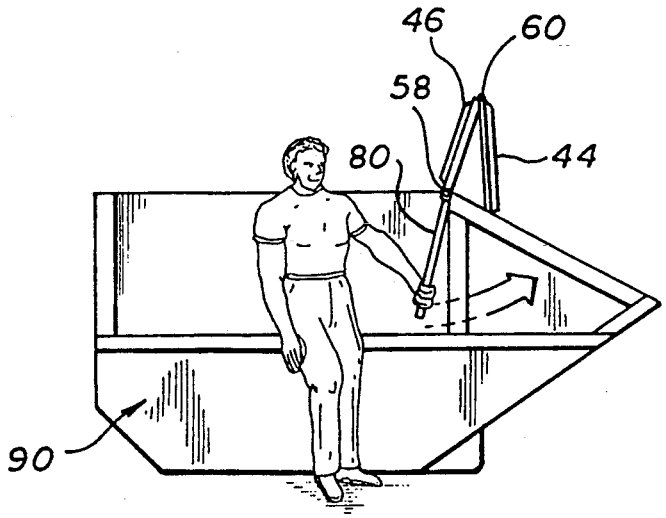
FIG. 4
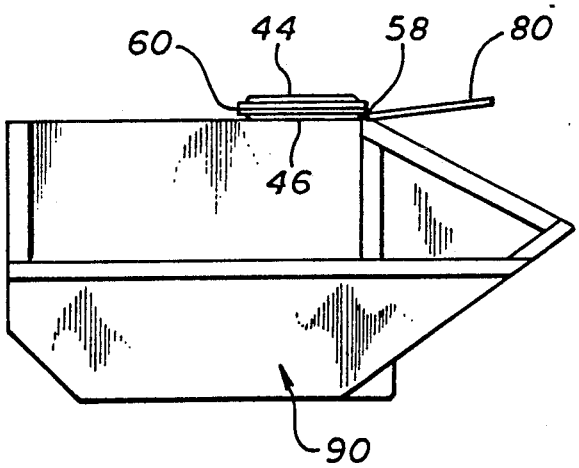
FIG. 5

VERSATILE DOUBLE ACTUATION TRASH CONTAINER LID

FIELD OF THE INVENTION

This invention relates to plastic lids having two sections which are hinged together for large trash containers. More particularly, this invention relates to a versatile double actuation lid assembly for commercial trash containers.

BACKGROUND OF THE INVENTION

One known type of commercial trash container includes a main generally rectangular body portion and a slanted front access portion which has generally been covered by a two section lid. These trash containers come in various sizes and dimensions ranging from about 6 cubic yards capacity to about 16 cubic yards.

The original units had the slanted access portion covered by two hinged steel plates. A long lever was coupled to the hinge rod of the rear section, and as the lever was rotated, the rear section would be pivoted up, carrying the pivoting front section with the rear section and holding the front section against the rear section until they finally both lay flat on the top of the rear portion of the unit with the front access opening wide open.

A double hinged plastic lid design was disclosed in United Kingdom Design Patent No. D2011302, granted to Craig V. Taylor on May 2, 1991. For adequate rigidity, both the front and the rear sections of the lid included upper and lower plastic layers joined to form a lid of increased strength and rigidity. However, in the closed configuration, the two adjacent edges of the front and rear sections engaged one another. Accordingly, in order to deposit trash, both lid sections had to be moved. This is, of course, inconvenient, particularly when small parcels of trash are to be deposited.

Incidentally, Craig V. Taylor U.S. Pat. No. 4,771,940, granted Sep. 20, 1988, discloses a two-layer plastic lid for a somewhat different type of container.

Another attempt at designing a cover has been illustrated in FIG. 1. The prior art lid depicted in FIG. 1 discloses, generally, a double-hinged lid for a commercial trash container, having a main rear, generally rectangular portion, and a front slanted, trash receiving portion. More particularly, the double-hinged lid 26 illustrated in FIG. 1 comprises a front lid section 28 and a rear lid section 30 which are pivotally joined. Rear lid section 30 is pivotally mounted to container 20 at 23. A pair of angle irons 27 are fixedly attached to rear lid section 30 along both edges thereof, and to a pivoting torsion bar extending across the assembly along the pivot axis 23; and the pivoting torsion bar is operatively coupled to the actuating lever 32. Operation of this double-hinged lid involves physically manipulating the actuating lever 32 in a clockwise direction, which in turn raises rear lid section 30. The person using this lid is then required to swing front lid portion 28 over and behind rear lid section 30, positioning front lid section 28 so that it rests flat on the rear portion of trash container 20 beneath the rear section 30.

SUMMARY OF THE INVENTION

It would be desirable to use plastic lids instead of steel lids, but as discussed above, the attempts to use plastic have not met all of the needs of the users. More specifically, it would be desirable to have a two section lid for this type of application which would fulfill the following:

1. The lid should be formed of plastic so that it is lightweight.
2. The front lid section should have a convenient stable open position, so that small items of trash could be easily deposited.
3. When the unit is to be fully opened with the usual operating lever, the two lid sections should open smoothly and automatically rest flat on top of one another without any manual adjustment other than full movement of the operating lever.
4. The two sections of the lid should be pivoted together at a single pivot point with a single rod, for simplicity, stability, and low weight considerations.
5. For the mass shipping and storage of lids, the lids should nest readily.
6. The lids should have sufficient strength and stability so that they do not bend unduly when the lids are opened and closed, which could cause jamming.

It is noted that lid constructions have been proposed heretofore which meet some of these needs or which include some of these desirable features, but no lid structures have been proposed heretofore which include all of them. Problems which have been encountered include (1) sagging of the lids over the six foot transverse span; (2) deformation of the lids so that one edge or corner enters the trash container as a result of double pivoting or insufficient rigidity; (3) the need to manually position the lids as they are being fully opened with the operating lever; and (4) impracticality of simple partial opening to deposit small items of trash. Other shortcomings have also been present in prior art lid constructions.

In accordance with one illustrative embodiment of the invention, the two lid sections are formed with two layers, and a recessed box like construction to provide high strength and cover-to-cover rigidity; and the front and rear sections are pivoted together about a single pivot point with a single rod passing through extended lugs, with the angle of clearance from the pivot point to the main portions of the two sections of the lids being greater than 90 degrees and preferably in the order of at least 120 degrees so that with a 25 degrees angle on the front end of the trash containers, the front section may be tilted back to a stable open position. More generally, with the front loading opening of the commercial trash container slanting forward by a predetermined acute angle relative to the horizontal, the interference angle between the front and rear sections of the plastic lid assembly, from the pivot point, is at least equal to the sum of the predetermined acute slant angle of the front opening plus ninety degrees, so that the front section is at least in a stable vertical or slightly past vertical orientation when fully opened with the rear section closed, to deposit small items of refuse.

Concerning another minor aspect of the invention, the central mounting and pivot lugs between the front and rear sections have offset mounting openings which raise the center of the lid, to direct the rain water off of the upper lid to both sides.

In accordance with a further feature of the invention, the sections of the lid have box-like recesses on their lower surfaces, with slanted inner walls and mating angled raised positions on the upper surfaces so that the lid sections will nest. To complete the nesting capability of the lid sections, the pivot lugs where the lid sections mate, have recesses on their upper surfaces to match the downwardly extending lugs, which downward extent is required so that the pivot line of the two lid sections is aligned with the lower surfaces of the lid.

The double hinged lids of the present invention may also be used with somewhat smaller commercial trash bins having a rectangular horizontal cross-section and an open top with a flat or slightly slanted top opening. For these smaller containers, an actuating lever may not be necessary; instead, the sides of the rear lid section may be provided with handles, or the rear lid section may extend laterally slightly beyond the edges of the open top of the container, to permit direct manual rotation of the rear section of the lid. Concerning the clearance angle mentioned above, when the trash receiving opening is horizontal, the angle of the opening with respect to the horizontal is 0 degrees; and the clearance angle only needs to be 90 degrees or slightly more than 90 degrees to provide a stable open position for the front lid section while the rear lid section remains closed for convenience in depositing small items of trash.

Incidentally, the alignment of the pivot point of the two lids with the lower surfaces of both of the lids is desirable in order for the lids to fold down flat on top of one another and on top of the rear portion of the commercial trash bin.

Other objects, features and advantages will become apparent from a consideration of the following detailed description and from the accompanying drawings.

BRIEF DESCRIPTION OF THE DRAWINGS

FIG. 1 is a perspective view of a prior art refuse container and cover;

FIG. 2 is a side view of a container cover in the closed position, illustrating the principles of this invention, used in conjunction with a refuse container;

FIG. 3 is a side view of the container cover of FIG. 2 in its stable partially open position;

FIG. 4 is a side view of the container cover of FIG. 2, illustrating the use of the actuating lever to fully open or close the container front;

FIG. 5 is a side view of the container cover of FIG. 2 in its fully open position, illustrating the two lid sections smoothly and automatically resting on top of one another;

DETAILED DESCRIPTION OF THE PREFERRED EMBODIMENT

Figure 6:
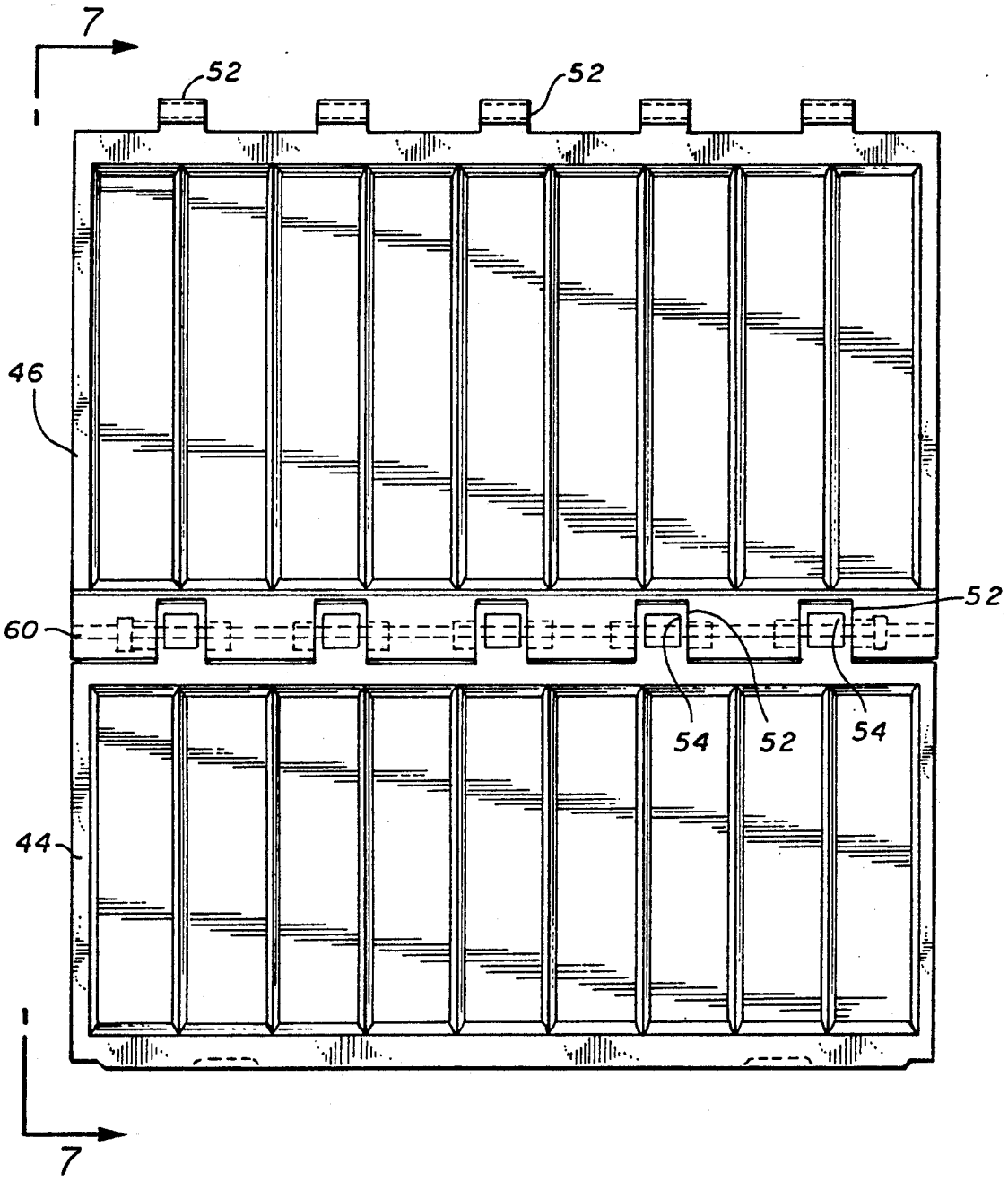
FIG. 6 is a top plan view of the container cover of FIG. 2.

One preferred embodiment of the versatile double actuation lid assembly for commercial trash containers, having a main rear generally rectangular portion and a front trash receiving portion with a slanted front opening making a predetermined acute angle with respect to the horizontal, is disclosed in the present detailed description. With reference to FIG. 2 the versatile double actuation lid assembly 40 of this preferred embodiment comprises, generally, a front lid section 44 pivotally mounted to a rear lid section 46. The rear lid section 46 is pivotally mounted at 78 to the upper portion of the slanted front opening portion 94 of refuse container 90. A hinged actuating lever 80 is rigidly secured to a pivot or torsion bar 58 and to two angle irons 81 extending along the opposite edges of rear lid section 46.

Various configurations of this invention while in use are illustrated in FIGS. 2–5. The double actuation lid assembly is illustrated in FIG. 2 in its fully closed position. With reference to FIG. 3, the double actuation lid assembly 40 is portrayed in its stable partially opened position. By inserting the user's hand under the front edge of front lid section 44 of the double actuation lid 42 and lifting, the front lid section 44 may be opened to a stable position slightly beyond the vertical, while the rear lid section 46 remains fully closed. This configuration allows for the deposit of small items of trash, such as the item 47 as shown in this Figure.

Figure 8:
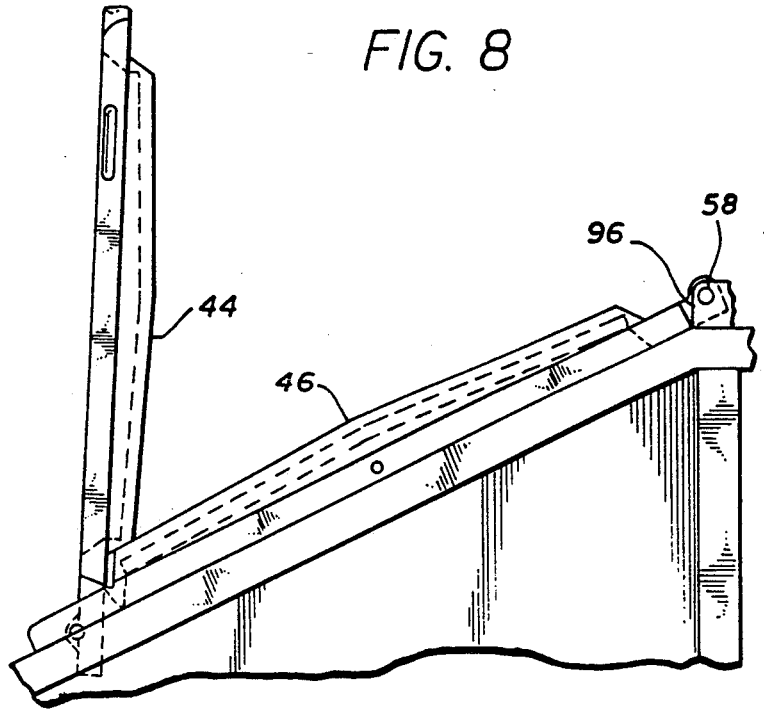
FIG. 8 is an enlarged side view similar to FIG. 3 showing the interfering surfaces of the lids.

FIG. 8 illustrates more particularly the structure by which the front lid section 44 remains stable in the partially open position. Angled edge 102 of lid section 44 abuts the upper surface 106 of lid section 46. As seen in FIG. 8, lid section 44 is in a position slightly offset from a vertical axis that can be imagined passing through pivot bar 60. In this position, gravity maintains angled edge 102 in contact with upper surface 106. consequently, lid section 44 will remain in the partially open position until the user closes the lid.

With reference to FIG. 4, actuating lever 80 is manipulated either clockwise or counter clockwise causing rear lid section 46 to radially descend or ascend around a fulcrum located at the center of rear pivot bar 58. The radial movement of rear lid section 46 generates radial movement of the pivotally joined front lid section 44. The radial movement of front lid section 44 revolves around an axis located at the center of front pivot bar 60 which intercouples the two lid sections. Continued counterclockwise manipulation of actuating lever 80, as illustrated in FIG. 5, causes lid 42 to assume its fully opened rest position. While in this position, front lid section 44 folds flat on top of rear lid section 46. In its folded position, lid 42 has front lid section 44 resting on top of rear lid section 46, and rear section 46 rests on top of the rear portion of the commercial refuse container 90. Further, this action requires no manual operations, other than actuation of the lever 80.

Figure 7:
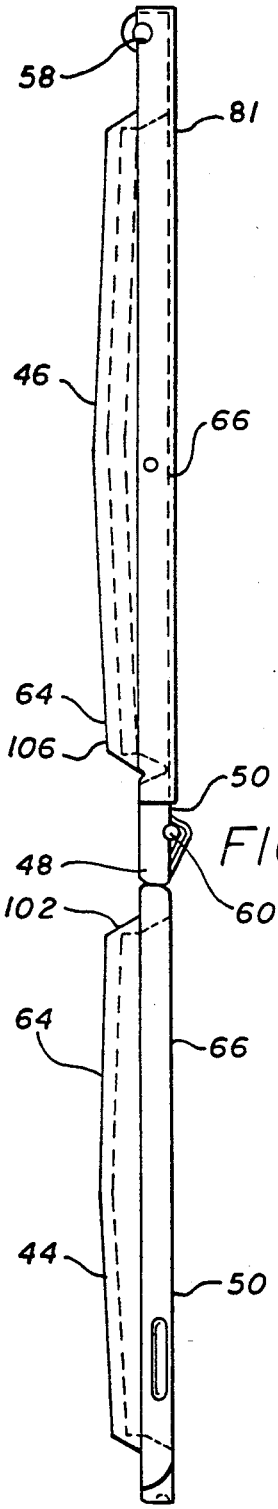
FIG. 7 is a side view of the container cover of FIG. 6.

More particularly, as shown in FIGS. 6 and 7, the double actuation lid 42 of the present embodiment comprises a front lid section 44 and a rear lid section 46. These lid sections have aligned lower edge surfaces 50 for resting on the edges of the front opening 94 of refuse container 90. Lid sections 44 and 46 are pivotally joined by the extension of hinge lugs 52 on each lid section extending toward the other lid section and a pivot bar 60 extending through openings 54 in hinge lugs 52.

FIG. 7 shows that the central axis of pivot bar 60 crosses the surface of a plane defined by the lower surfaces of the front and rear lid sections. This alignment of the pivot bar allows the lid sections to lie flat atop one another in the fully open position, as in FIG. 5.

Figure 12:
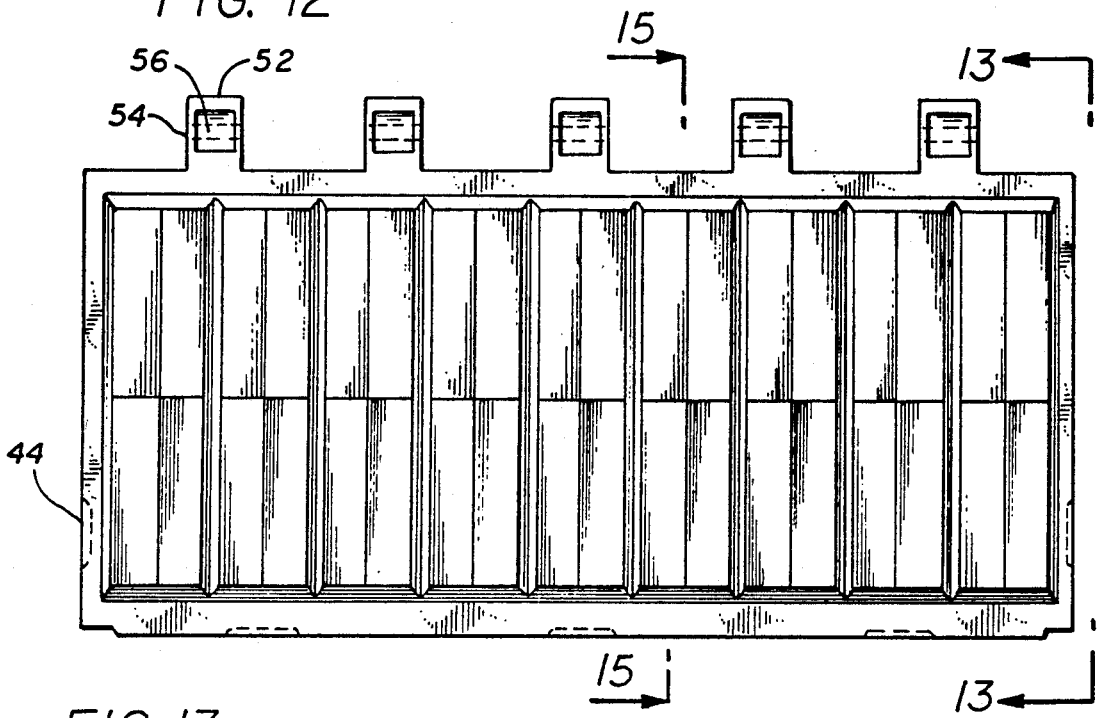
FIG. 12 is a top plan view of a front portion of the container cover of FIG. 6.

The hinge lugs 52 have recesses 56 on their upper surfaces. These recesses 56 insure that hinge lugs 52 have sufficient space to receive the lower portion 57 of the hinge lugs of adjacent nested parts (see FIGS. 12, 13 and 14).

Figure 16:
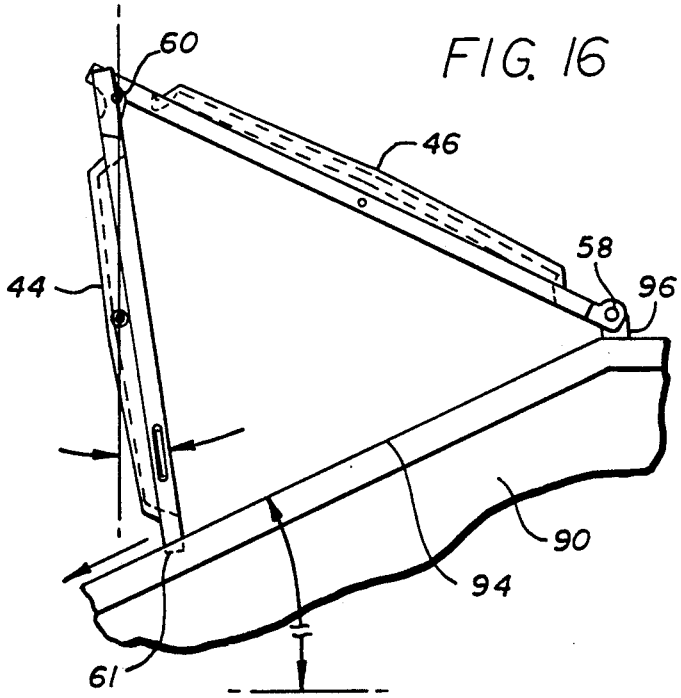
FIG. 16 is a side view of the container cover of FIG. 3 showing the impingement of the front corners of the front section of the lid on the slanted sides of the container.
Figure 9:
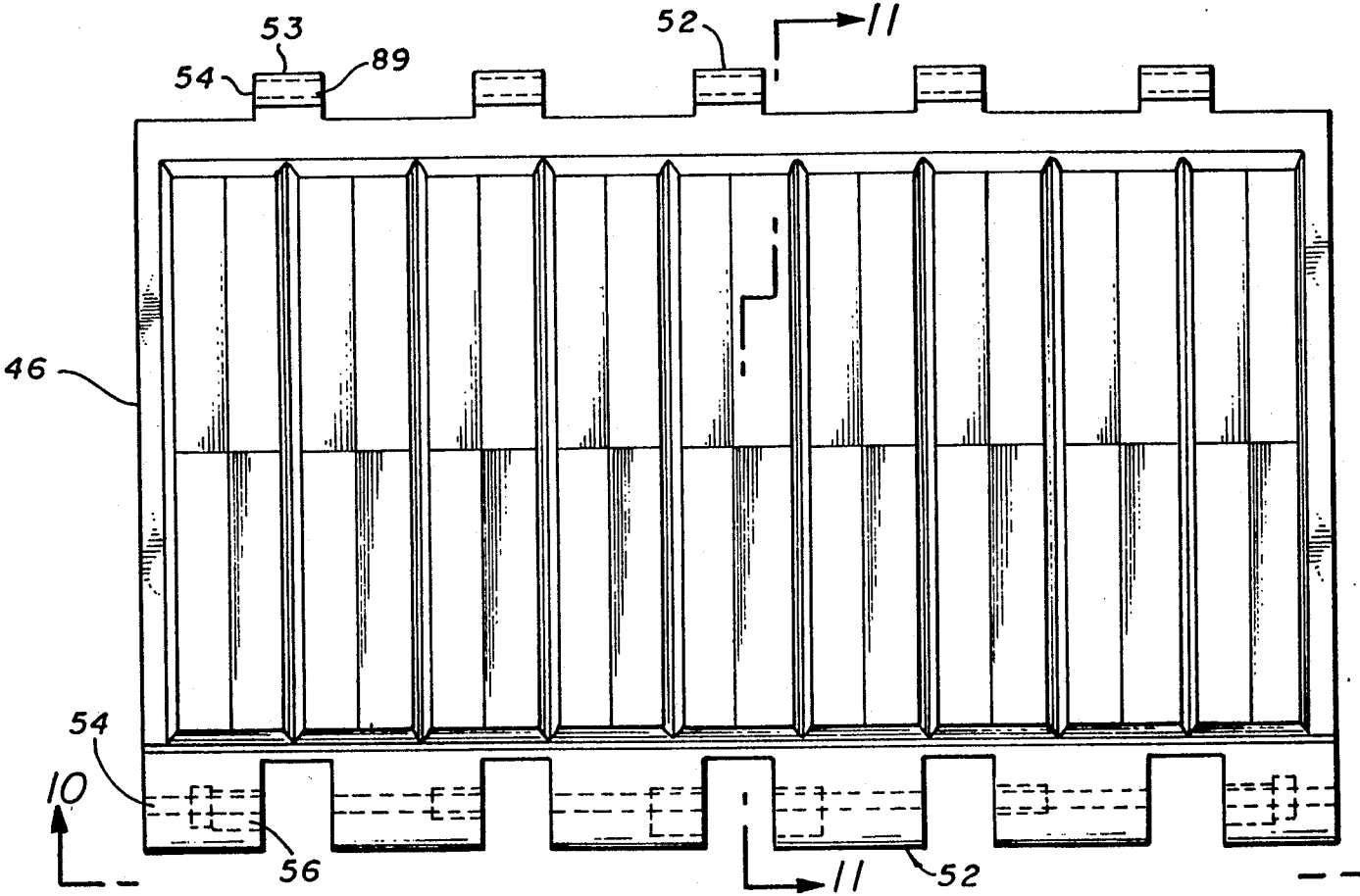
FIG. 9 is a top plan view of the rear portion of the container cover of FIG. 6.
Figure 10:
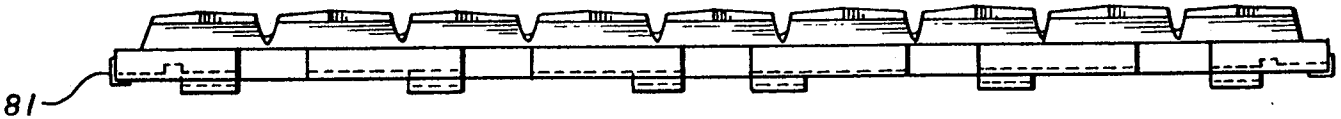
FIG. 10 is a front view of the rear portion of the container cover of FIG. 9.
Figure 11:
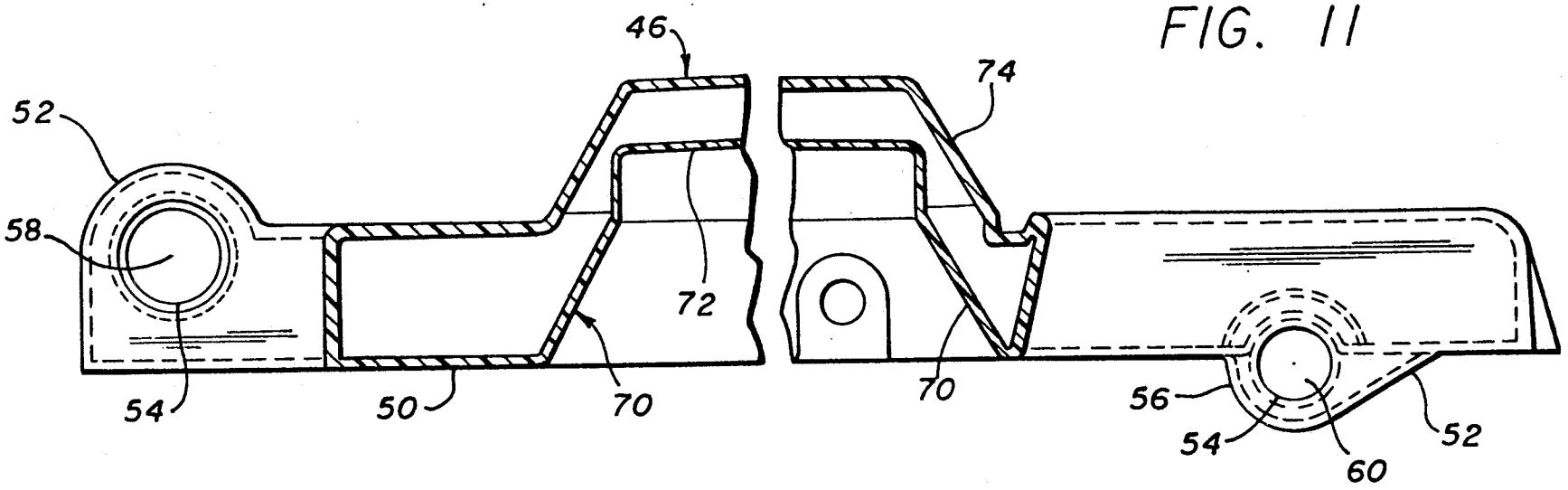
FIG. 11 is a partial transverse cross-sectional view of the rear portion of the container cover of FIG. 9 illustrating the dual pivotal arrangements.
Figure 15:
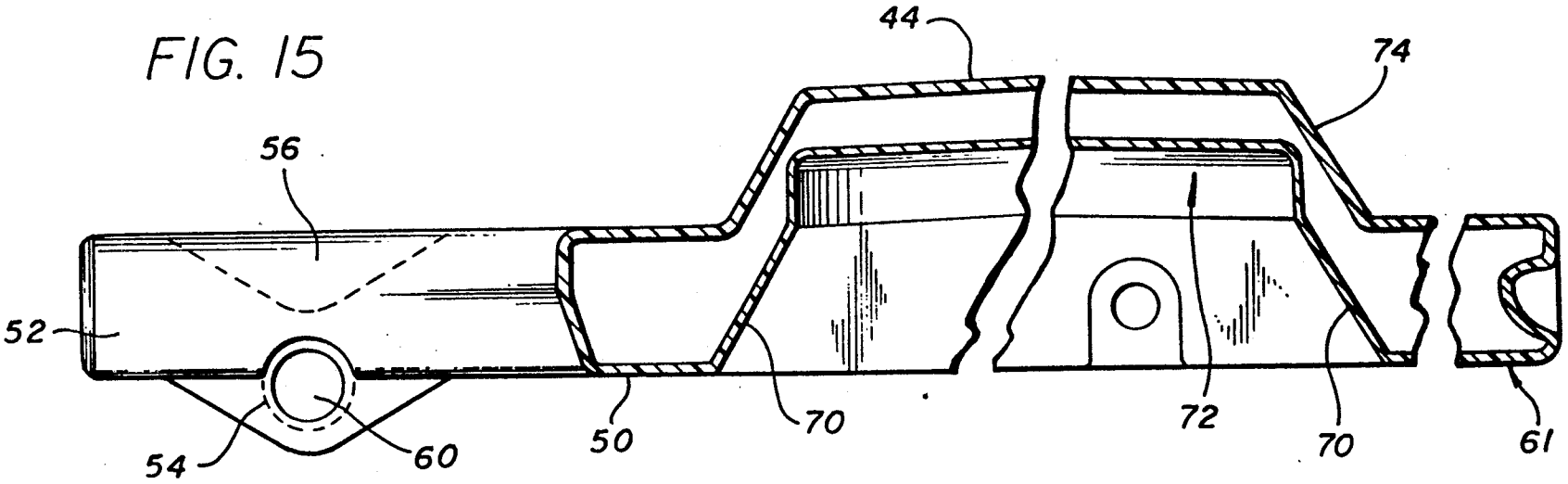
FIG. 15 is a partial transverse cross-sectional view through the front lid of FIG. 12.
Figure 13:
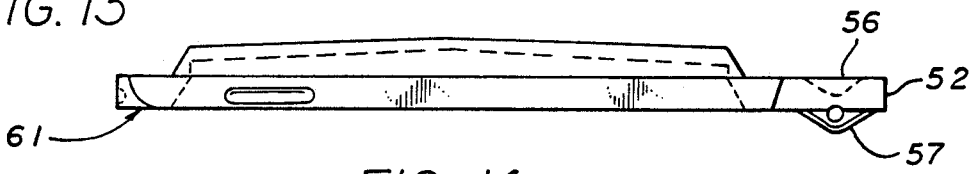
FIG. 13 is a side view of the front portion of the lid as shown in FIG. 12.
Figure 14:
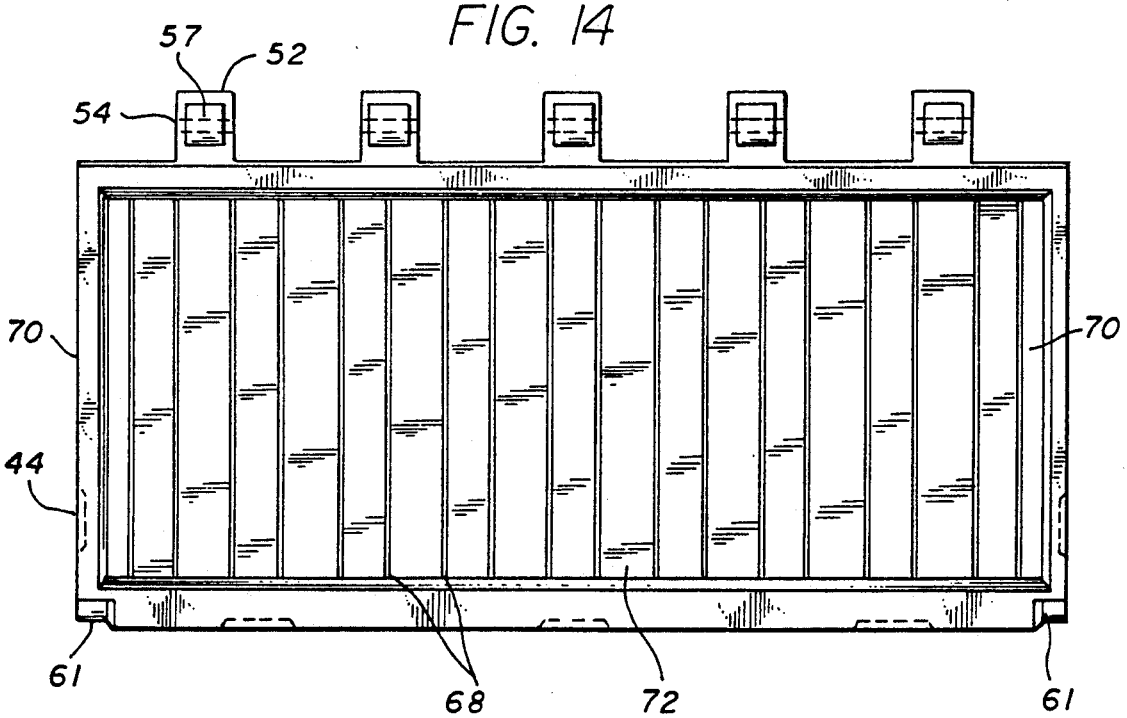
FIG. 14 is a bottom plan view of the front portion of the container cover of FIG. 6.

Both the front and rear lid sections 44 and 46 are formed of two spaced layers 64 and 66 constructed of plastic material. These materials are contoured in such a way as to provide a sufficient clearance angle between the upper surfaces of the front lid section 44 and the rear lid section 46, using the center of the pivot bar 60 as the fulcrum of the clearance angle. It is preferred that the clearance angle be greater than 90 degrees plus the predetermined acute angle of the front opening 94 of refuse container 90, relative to the horizontal. Further, as illustrated in FIGS. 13, 14 and 16, front lid section 44 is rounded at front corners 61. This rounded front edge 61 enhances the sliding motion of front lid section 44 along the edges of the front opening 94 of refuse container 90, in conjunction with the raising or lowering of rear lid section 46 and the concurrent movement of the front section.

As shown to advantage in FIG. 3, the front view of the front section of the lid, and in FIG. 14, the bottom view of this front section, immediately adjacent the rounded areas 61 of the front corners of the lid section are portions of the lid section which engage the inner sides of the container to guide and prevent misalignment of the lid as it is closed.

Both lid sections of the double actuation lid 42 have ribs 68 and edges 70 forming a box-like lower structural configuration. Further, front lid section 44 and rear lid section 46 are recessed on their lower sides and raised on their upper surfaces. The front lid section 44 and the rear lid section 46 have coordinated slanted surfaces at the sides of the recesses 72 and the sides of the raised areas 74 insuring that the lid sections may be nested for shipment or storage with the raised areas fitting into the recessed areas (for a plurality of the front sections 44 or a plurality of the rear sections 46).

There are at least two end hinge lugs 52 and at least one intermediate hinge lug 52 associated with the front edge 48 of rear lid section 46. All of these pivot lugs 52 have openings 54 for receiving pivot bar 60. The openings 54 on the intermediate lugs 52 are shifted in position relative to the openings 54 on the two end pivot lugs 52 to force the center of the lid higher. This compensates for sag toward the middle of the lid sections 44 and 46, and further insures that rain will be diverted to the sides of the refuse container 90.

A final element embodied by the present example is the means for radially actuating the lid sections. Included in this portion of the double actuation lid assembly 40 are hinge lugs 52 extending from the rear of rear lid section 46 and mounts 96 extending from the steel refuse container 90, respectively, pivot bar 58, and actuating lever 80. Hinge lugs 52 extend from the rear edge of the rear lid section 46. Pivot bar 58 extends through openings 54 bearings on the mounts 96 (see FIG. 8). Actuating lever 80 may be fixedly attached to pivot bar 58 and to two angle irons 81, or may be removable therefrom Further, lever 80 may embrace a variety of forms, including but not limited to a wheel or a s-shaped crank lever.

While a particular preferred embodiment has been disclosed, it will be understood that variations and modifications may be included without departing from the spirit and scope of this invention. By way of example but not of limitation, the plastic lids may have different ribbed and lug configurations, and other pivot arrangements may be employed. Accordingly, the present invention is not limited to the precise arrangements shown in the drawings and described in detail herein.

What is claimed is:

1. A versatile double actuation lid assembly for commercial trash containers having a trash receiving opening making a predetermined angle with respect to the horizontal, said double actuation lid comprising:

a front lid section and a rear lid section, said lid sections having aligned lower edge surfaces for resting on edges of said opening, said lid sections each having an upper surface;

means for pivotally actuating said lid sections together, including a plurality of extending hinge lugs on each of the lid sections, each of said hinge lugs on each of said lid sections extending toward the other lid section, each of said hinge lugs having an opening, and a pivot bar extending through the openings in said hinge lugs, said pivot bar having a central axis that is aligned substantially with a plane defined by the lower edge surface of each of said lid sections; and means for allowing a user to open said front lid assembly to a vertically stable, partially open position while said rear lid assembly remains in a closed position;

said front lid section having an angled surface which abuts said upper surface of said rear lid section when said front lid section is in the stable partially open position and when said rear lid assembly remains in a closed position;

whereby the front section of said lid may be opened to a stable position slightly beyond the vertical, while said rear lid section remains fully closed, for the deposit of small items of trash.

2. A versatile lid assembly as defined in claim 1 wherein each of said lid sections is formed of two spaced layers of plastic material.

3. A versatile lid assembly as described in claim 1 wherein said plurality of hinge lugs of said rear lid section comprises two end pivot lugs and at least one intermediate pivot lug, said openings on the intermediate lugs being offset relative to said openings on the two end pivot lugs to compensate for sag toward a middle of said lid sections and to divert rain toward the sides of said trash container.

4. A versatile lid assembly as defined in claim 1 wherein said means for pivotally actuating said lids sections together causes said lid sections to fold flat with the front lid section on top of the rear lid section, and the rear lid section on top of the rear portion of said commercial trash container.

5. A versatile lid assembly as defined in claim 1, wherein:

said front lid section and said rear lid section have recessed lower sides and raised upper ribs, said raised upper ribs having dimensions so that said raised upper ribs may fit into recesses defined by said recessed lower sides;

whereby said lid sections may be nested for shipment or storage, said raised upper ribs fitting into the recesses of said recessed lower sides.

6. A versatile lid assembly as defined in claim 5 wherein said hinge lugs have upper surfaces, said upper surfaces having recesses to receive lower portion of hinge lugs from an adjacently nested lid section.

7. A versatile lid assembly as defined in claim 1 wherein said rear section of said lid assembly is to be pivotally attached to the trash container at a rear edge of said rear lid section.

8. A versatile lid assembly as defined in claim 7 wherein said assembly includes means for rotating said rear lid section about the rear edge where said rear lid section is to be pivotally mounted to the container.

9. A versatile lid assembly as defined in claim 1 wherein said front lid section includes rounded front corners, said rounded corners facilitating the movement of said front lid section along said opening of said trash container.

10. A versatile lid assembly as defined in claim 9, further comprising means immediately adjacent said rounded corners for guiding said front lid section and preventing misalignment as the lid assembly is being closed.

11. A versatile double actuation lid assembly for commercial trash containers having a trash receiving opening making a predetermined angle with respect to the horizontal, said double actuation lid comprising:

a front lid section and a rear lid section, said lid sections having aligned lower edge surfaces for resting on edges of said opening, said lid sections each having an upper surface;

means for pivotally actuating said lid sections together, including a plurality of extending hinge lugs on each of the lid sections, each of said hinge lugs on each of said lid sections extending toward the other lid section, each of said hinge lugs having an opening, a pivot bar having a central axis, the pivot bar extending through the openings in said hinge lugs, said central axis of said pivot bar being aligned substantially with a plane defined by the lower edge surface of each of said lid sections, and an actuating lever providing said means for pivotally actuating said lid sections together; and means for allowing a user to open said front lid assembly to a vertically stable, partially pen position while said rear lid assembly remains in a closed position;

said front lid section having an angled surface which abuts said upper surface of said rear lid section when said front lid section is in the stable partially open position.

12. A versatile lid assembly as described in claim 11 wherein said plurality of hinge lugs of said rear lid section comprise two end pivot lugs and at least one intermediate pivot lug, said openings on the intermediate lugs being offset relative to said openings on the two end pivot lugs to compensate for sag toward a middle of said lid sections.

13. A versatile lid assembly as defined in claim 11 wherein said means for pivotally actuating said lids sections together causes said lid sections to fold flat with the front lid section on top of the rear lid section, and the rear lid section on top of the rear portion of said commercial trash container.

14. A versatile lid assembly as defined in claim 11, wherein:

said front lid section and said rear lid section have recessed lower sides and raised upper ribs, said raised upper ribs having dimensions so that said raised upper ribs may fit into recesses defined by said recessed lower sides;

whereby said lid sections may be nested for shipment or storage, said raised upper ribs fitting into the recesses of said recessed lower sides.

15. A versatile lid assembly as defined in claim 14 wherein said hinge lugs have upper surfaces, said upper surfaces having recesses to receive lower portion of hinge lugs for an adjacently nested lid section.

16. A versatile lid assembly as defined in claim 11 wherein said means for pivotally actuating said rear lid sections together to rest on a top of said refuse container further comprises:

rear hinge lugs on the rear of the rear lid section opposite said hinge lugs extending toward said front lid section; and a pivot bar extending through openings in said rear hinge lugs, said pivot bar being secured to said actuating lever; and said rear lid section being secured to rotate with said pivot bar;

whereby the rear lid section may be actuated pivotally to rest on top of the rear portion of said trash container.

17. A versatile lid assembly as defined in claim 11 wherein actuating lever comprises an arm extending perpendicularly from said pivot bar.

18. A versatile lid assembly as defined in claim 11 wherein actuating lever is removable from said pivot bar.

19. a versatile lid assembly as defined in claim 11 wherein said front lid section comprises rounded front corners, said rounded corners facilitating the movement of said front lid section along said opening of said trash container.

20. A versatile lid assembly as defined in claim 19, further comprising means immediately adjacent said rounded corners for guiding said front lid section and preventing misalignment as the lid assembly is being closed.

21. A versatile double actuation lid assembly for commercial trash containers having a trash receiving opening making a predetermined angle with respect to the horizontal, said double actuation lid comprising:

a front lid section and a rear lid section, said lid sections having aligned lower edge surfaces for resting on edges of said opening, said lid sections each having an upper surface;

each of said lid sections being formed of two spaced layers of plastic material;

means for pivotally actuating said lid sections together, including a plurality of extending hinge lugs on each of the lid sections, each of said hinge lugs on each of said lid sections extending toward the other lid section, each of said hinge lugs having an opening, and a pivot bar having a central axis, the pivot bar extending through the openings in said hinge lugs, said central axis of said pivot bar being aligned substantially with a plane defined by the lower edge surface means for allowing a user to open said front lid assembly to a vertically stable, partially open position while said rear lid assembly remains in a closed position;

said front lie section having an angled surface which abuts said upper surface of said rear lid section when said front lid section is in the stable partially open position, and whereby the front section of said lid may be opened while said rear lid section of said lid may be opened while said rear lid section remains fully closed, for the deposit of small items of trash.

22. A versatile lid assembly as defined in claim 21 wherein both said front lid section and said rear lid section are ribbed and have edges forming a box like lower structural configuration, with each of the lid sections being recessed on a lower side and raised on said upper surface, so that the lid sections may be nested for shipment or storage with the raised areas fitting into the recessed areas for a plurality of the front sections or a plurality of the rear sections.

23. A versatile lid assembly as defined in claim 21 wherein said front lid section includes rounded front corners; said rounded corners facilitating the movement of said front lid section along said opening of said trash container.

24. A versatile lid assembly as defined in claim 23, further comprising means immediately adjacent said rounded corners for guiding said front lid section and preventing misalignment as the lid assembly is being closed.

25. A versatile lid assembly as defined in claim 21, wherein:

said front lid section and said rear lid section have recessed lower sides and raised upper ribs, said raised upper ribs having dimensions so that said raised upper ribs may fit into recesses defined by said recessed lower sides;

whereby said lid sections may be nested for shipment or storage, said raised upper ribs fitting into the recesses of said recessed lower sides.

26. A versatile double actuation lid assembly for commercial trash containers having a trash receiving opening making a predetermined angle with respect to the horizontal, said double actuation lid comprising:

a front lid section and a rear lid section, said lid sections having aligned lower edge surfaces for resting on edges of said opening, said lid sections each having an upper surface;

means for pivotally actuating said lid sections together, including a plurality of extending hinge lugs on each of the lid sections, each of said hinge lugs on each of said lid sections extending toward the other lid section, each of said hinge lugs having an opening, and a pivot bar extending through the openings in said hinge lugs, said pivot bar being aligned substantially with the lower edge surface of each of said lids sections; and wherein said front lid section has an angled surface which abuts said upper surface of said rear lid section when said front lid section is in a vertically stable, partially open position and when said rear lid section remains in a closed position;

wherein said plurality of hinge lugs of said rear lid section comprises two end pivot lugs and at least one intermediate pivot lug, said openings on the intermediate lugs being offset relative to said openings on the two end pivot lugs to compensate for sag toward a middle of said lid sections and to divert rain toward the sides of said trash container;

whereby the front section of said lid may be opened to a stable position slightly beyond the vertical, while said rear lid sections remains fully closed, for the deposit of small items of trash.

27. A versatile double actuation lid assembly for commercial trash containers having a trash receiving opening making a predetermined angle with respect to the horizontal, said double actuation lid comprising:

a front lid section and a rear lid section, said lid sections having aligned lower edge surfaces for resting on edges of said opening, said lid sections each having an upper surface;

means for pivotally actuating said lid sections together, including a plurality of extending hinge lugs on each of the lid sections, each of said hinge lugs on each of said sections extending toward the other lid section, each of said hinge lugs having an opening, and a pivot bar extending through the openings in said hinge lugs, said pivot bar being aligned substantially with the lower edge surface of each of said lid sections; and wherein said front lid section has an angled surface which abuts said upper surface of said rear lid section when said front lid section is in a vertically stable, partially open position and when said rear lid section remains in a closed position;

said front lid section and said rear lid section have recessed lower sides and raised upper ribs, said raised upper ribs having dimensions so that said raised upper ribs may fit into recesses defined by said recessed lower sides;

said raised upper ribs having a box-like cross section;

said hinge lugs having upper surfaces, said upper surfaces having recesses to receive a lower portion of hinge lugs from; adjacently nested lid section whereby the front section of said lid may be opened to a stable position slightly beyond the vertical, while said rear lid section remains fully closed, for the deposit of small items of trash, and the lid sections may be nested for shipment or storage, said raised upper ribs fitting into the recesses of said recessed lower sides.

28. A versatile double actuation lid assembly for commercial trash containers having a trash receiving opening making a predetermined angle with respect to the horizontal, said double actuation lid comprising:

a front lid section and a rear lid section, said lid sections having aligned lower edge surfaces for resting on edges of said opening, said lid sections each having an upper surface;

means for pivotally actuating said lid sections together, including a plurality of extending hinge lugs on each of the lid sections, each of said hinge lugs on each of said sections extending toward the other lid sections, each of said hinge lugs having an opening, a pivot bar wherein said front lid section has an angled surface which abuts said upper surface of said rear lid section when said front lid section is in a vertically stable, partially open position and when said rear lid section remains in a closed position;

wherein said plurality of hinge lugs of said rear lid section comprises two end pivot lugs and a least one intermediate pivot lug, said openings on the intermediate lugs being offset relative to said openings on the two end pivot lugs to compensate for sag toward a middle of said lid sections and to divert rain toward the sides of said trash container;

whereby the front section of said lid may be opened to a stable position slightly beyond the vertical, while said rear lid section remains fully closed, for the deposit of small items of trash.

29. A versatile double actuation lid assembly for commercial trash containers having a trash receiving opening making a predetermined angle with respect to the horizontal, said double actuation lid comprising:

a front lid section and a rear lid section, said lid sections having aligned lower edge surfaces for resting on edges of said opening, said lid sections each having an upper surface;

means for pivotally actuating said lid sections together, including a plurality of extending hinge lugs on each of the lid sections, each of said hinge lugs on each of said sections extending toward the other lid section, each of said hinge lugs having an opening, and a pivot bar extending through the openings in said hinge lugs, said pivot bar being aligned substantially with the lower edge surface of each of said lid sections, and an actuating lever providing said means or pivotally actuating said lid sections together; and wherein said front lid section has an angled surface which abuts said upper surface of said rear lid section when said front lid section is in a vertically stable, partially open position and when said rear lid section remains in a closed position;

said front lid section and said rear lid section have recessed lower sides and raised upper ribs, said raised upper ribs having dimensions so that said raised upper ribs may fit into recesses defined by said recessed lower sides;

said raised upper ribs having a box-like cross section;

said hinge lugs having upper surfaces, said upper surfaces having recesses to receive a lower portion of hinge lugs from an adjacently nested lid section;

whereby the front section of said lid may be opened to a stable position slightly beyond the vertical, while said rear lid section remains fully closed, for the deposit of small items of trash, and the lid sections may be nested for shipment or storage, said raised upper ribs fitting into the recesses of said recessed lower sides.

* * * * *